US008142171B2

(12) United States Patent
Yukitake

(10) Patent No.: US 8,142,171 B2
(45) Date of Patent: Mar. 27, 2012

(54) ELECTRIC PUMP UNIT AND ELECTRIC OIL PUMP

(75) Inventor: Yasuhiro Yukitake, Kashiwara (JP)

(73) Assignee: JTEKT Corporation, Osaka-Shi, Osaka (JP)

( * ) Notice: Subject to any disclaimer, the term of this patent is extended or adjusted under 35 U.S.C. 154(b) by 369 days.

(21) Appl. No.: 12/448,041

(22) PCT Filed: Dec. 4, 2007

(86) PCT No.: PCT/JP2007/073407

§ 371 (c)(1),
(2), (4) Date: Jun. 5, 2009

(87) PCT Pub. No.: WO2008/075557

PCT Pub. Date: Jun. 26, 2008

(65) Prior Publication Data

US 2010/0008797 A1 Jan. 14, 2010

(30) Foreign Application Priority Data

Dec. 19, 2006 (JP) ..... 2006-341429

(51) Int. Cl.
*F04B 53/00* (2006.01)
*F04B 35/04* (2006.01)

(52) U.S. Cl. ..... 417/310; 417/410.1

(58) Field of Classification Search ..... 417/410.1, 417/15, 363, 366, 418, 310, 295, 296, 307, 417/53; 192/3.3; 310/156.56; 418/55.1–55.6, 418/57, 270; 184/6.16, 6.17
See application file for complete search history.

(56) References Cited

U.S. PATENT DOCUMENTS

| | | | | |
|---|---|---|---|---|
| 5,181,835 | A * | 1/1993 | Cook | 417/310 |
| 6,881,170 | B2 | 4/2005 | Onoyama et al. | |
| 2006/0222527 | A1 | 10/2006 | Kurita et al. | |

FOREIGN PATENT DOCUMENTS

| | | |
|---|---|---|
| JP | 63-22394 | 2/1988 |
| JP | 9-256969 | 9/1997 |
| JP | 11-13641 | 1/1999 |
| JP | 2001-182669 | 7/2001 |
| JP | 2002-317772 | 10/2002 |
| JP | 3743421 | 11/2005 |
| JP | 2006-233867 | 9/2006 |
| JP | 2007-49857 | 2/2007 |

* cited by examiner

*Primary Examiner* — Joseph L Williams
(74) *Attorney, Agent, or Firm* — McGinn IP Law Group, PLLC

(57) ABSTRACT

An electric pump unit includes an outer rotor, an inner rotor which meshes with the outer rotor in such a state that the inner rotor and the outer rotor are placed eccentrically to each other and which is driven by being supported by a rotation shaft of an electric motor, a pump housing which defines a cavity portion which accommodates therein the outer rotor and the inner rotor, inlet and outlet ports which are provided on inlet and outlet sides, respectively, so as to suck and discharge a fluid and which communicate with each other via the cavity portion, and a fluid circulating unit for circulating the fluid from the outlet side to the inlet side when a fluid pressure at the outlet side reaches or exceeds a predetermined pressure.

7 Claims, 4 Drawing Sheets

SECTIONAL VIEW TAKEN ALONG THE LINE X-X

SECTIONAL VIEW TAKEN ALONG THE LINE Y-Y

ELECTRIC PUMP UNIT AND ELECTRIC OIL PUMP

TECHNICAL FIELD

The present invention relates to an electric pump unit into which a pump part which sucks an oil (a fluid) thereinto and discharges the oil thereout and an electric motor for driving the pump part are unitized and an electric oil pump in which the electric pump unit is employed in a preferred fashion.

BACKGROUND ART

In recent years, to deal with the global environmental issues, electric oil pumps are being made widely use of in automotive transmissions for compensating for a reduction in oil pressure that occurs during idle stop.

There is a case where an electric pump unit which is made by unitizing a pump part which sucks an oil (a fluid) thereinto and discharges the oil thereout and an electric motor for driving the pump part is used as a drive source for those oil pumps. In the electric pump unit, by making the pump part double as a rotating shaft of the electric motor, a reduction in the number of components, reduction in size of the electric oil pump to a compact size and reduction in production costs are realized.

In this type of electric pump units, there is an electric pump unit which is made up of a trochoid pump in which a pump part is accommodated in a pump housing and which has an outer rotor having a trochoidal tooth profile and an inner rotor which is made to mesh with the outer rotor (refer to JP-A-2001-182669). On the other hand, the electric motor is accommodated in a motor housing which is integrated to communicate with the pump housing, so as to drive the pump part by the rotating shaft which supports the inner rotor.

DISCLOSURE OF THE INVENTION

Problem that the Invention is to Solve

In this electric pump unit, when it is used in the electric oil pump for the automotive transmission in the way described above, there occurs a case where the outlet side pressure thereof becomes higher than the discharge pressure of the pump part. When the electric motor which drives the pump part is put in an overloaded state by this, there has been a case where a so-called motor step-out phenomenon occurs in which an angle deviation is generated in the rotating portion of the electric motor and the rotation thereof comes to a halt, resulting in the electric motor eventually becoming unable to be restored from it.

The invention has been made with a view to solving the problem, and an object thereof is to provide an electric pump unit into which a pump part which sucks a fluid thereinto and discharges the fluid thereout and an electric motor are unitized, wherein a step-out phenomenon of the electric motor can effectively prevented which is generated by too large a pressure being applied to an outlet side of the pump part.

Means for Solving the Problem

With a view to solving the problem, a gist of a first invention resides in an electric pump unit comprising:

an outer rotor;

an inner rotor which meshes with the outer rotor in such a state that the inner rotor and the outer rotor are placed eccentrically to each other and which is driven by being supported by a rotation shaft of an electric motor;

a pump housing which defines a cavity portion which accommodates therein the outer rotor and the inner rotor;

inlet and outlet ports which are provided on inlet and outlet sides, respectively, so as to suck and discharge a fluid and which communicate with each other via the cavity portion; and a fluid circulating means for circulating the fluid from the outlet side to the inlet side when a fluid pressure at the outlet side reaches or exceeds a predetermined pressure.

According the configuration described above, the fluid circulating means for circulating the fluid from the outlet side to the inlet side when the fluid pressure at the outlet side reaches or exceeds the predetermined pressure is provided in the pump part which sucks and discharges the fluid. Because of this, since the oil is circulated from the outlet side to the inlet side so as to decrease the pressure at the outlet side before the fluid pressure becomes too large at the outlet side of the pump part to thereby put the electric motor in the overloaded state, the so-called motor step-out phenomenon (a synchronization error) can effectively be prevented in which an angle deviation is generated in the rotating portion of the electric motor and the rotation thereof comes to a halt, resulting in the electric motor eventually becoming unable to be restored therefrom.

A gist of a second invention resides in an electric pump unit as set forth in the first invention, wherein the fluid circulating means is a relief valve which is provided in such a manner as to face the inlet and outlet ports.

According to the configuration described above, by the fluid circulating means for circulating the fluid from the outlet side to the inlet side when the fluid pressure at the outlet side reaches or exceeds the predetermined pressure being made into the relief valve, the fluid circulating means can be made simple in construction and easy to be mounted in the electric pump unit as a mechanical component and allowed to respond quickly and operate in an ensured fashion.

A gist of a third invention reside in an electric pump unit as set forth in the second invention, wherein a pump plate is provided in such a manner as to seal the cavity portion, wherein crescent-shaped oil passages are formed at the inlet and outlet sides, respectively, in such a manner as to extend along outer circumferential circular arcs of the inner rotor and the outer rotor, wherein the inlet and outlet ports are formed in the pump plate in such a manner as to extend in the same direction along predetermined axes so as to communicate with the oil passages, respectively, and wherein the relief valve is provided in the pump plate in such a state that an axis in an operating direction thereof is made to intersect the axes of the inlet and outlet ports substantially at right angles in a plane which intersects the rotating shaft of the electric motor at right angles and in such a manner as to operatively communicate with the respective oil passages without communicating with the inlet and outlet ports.

According to the configuration described above, the relief valve and the inlet and outlet ports are provided in the pump plate without interfering with each other, and a space where to form the inlet and outlet ports can be ensured sufficiently without interrupting the operation of the relief valve in any way. In addition, since each port is formed in the pump plate in a direction which intersects an axial direction of the electric motor at right angles, the thickness of the pump plate can be made thin, and this comes to contribute to the miniaturization in size (the reduction in overall size) of the electric pump unit.

A gist of a fourth invention resides in an electric pump unit as set forth in the third invention, wherein thread portions are provided individually in the inlet and outlet ports in such a manner as to screw individually on to exterior pipings.

According to the configuration described above, since the space where to form the inlet port and the outlet port can be ensured sufficiently by the configuration of the third invention, in each port, the overall length of the thread portion which screws on to the exterior piping can be formed long and threads therein can be formed tall for improved strength. Because of this, the connection of the respective ports with the exterior pipings can be made secure and strong and rigid while miniaturizing the electric pump unit.

A gist of a fifth invention resides in an electric pump unit as set forth in the third or fourth invention, wherein a direction in which the outer rotor becomes eccentric relative to the inner rotor and a direction in which the respective ports extend outwards are made opposite to each other.

According to the configuration described above, since the direction in which the outer rotor becomes eccentric relative to the inner rotor and the direction in which the respective ports extend outwards are made opposite to each other, the two crescent-shaped oil passages which communicate respectively with the inlet side and the outlet side in the pump part and extend along the outer circumferential circular arcs of the respective rotors can be formed in the pump plate in such a state that they are made to lie close to each other on the opposite side in direction to the direction in which the respective rotors are made eccentric to each other. As a result, the relief valve can be provided in the space which is ensured widely on the side where both the rotors are made eccentric to each other without being occupied by the respective crescent-shaped oil passages. In addition, since the overall length of the thread portion which screws on to the exterior piping can be ensured sufficiently in the inlet port and the outlet port, the connection of each port with the exterior piping can be made secure and strong and rigid.

A gist of a six invention resides in an electric oil pump for compensating for a reduction in oil pressure which occurs during an idle stop in a transmission for a vehicle such as an automobile which employs the electric pump unit set forth in any of the first to fifth inventions.

According to the configuration described above, since the electric pump unit set forth in any of the first to fifth inventions is used as the electric oil pump for compensating for a reduction in oil pressure which occurs during the idle stop in the automotive transmission, the so-called motor step-out phenomenon can effectively be prevented in which the angle deviation is generated in the rotating portion of the electric motor due to the electric motor being put in the overloaded state by too large a fluid pressure being applied to the outlet side of the pump part and the rotation thereof comes to a halt, resulting in the electric motor eventually becoming unable to be restored therefrom, thereby making it possible to enhance the reliability of the electric pump unit as being used in the automobile.

ADVANTAGE OF THE INVENTION

According to the electric pump unit of the invention, the step-out phenomenon of the electric motor can effectively be prevented which is generated by too large a pressure being applied to the outlet side of the electric pump.

DESCRIPTION OF REFERENCE NUMERALS

2 pump part (trochoid pump); 3 electric motor; 4 relief valve (fluid circulating means); 11 pump housing; 12 motor housing; 13 pump plate; 13*a* suction port; 13*b* outlet port; 21 outer rotor; 21*a*, 22*a* tooth space (trochoidal tooth profile); 22 inner rotor; 25 pump chamber; 25*a* low pressure portion; 25*b* high pressure portion; 37 motor rotor.

BEST MODE FOR CARRYING OUT THE INVENTION

Hereinafter, the invention will be described with reference to an embodiment in accordance with the drawings.

Figure 1:
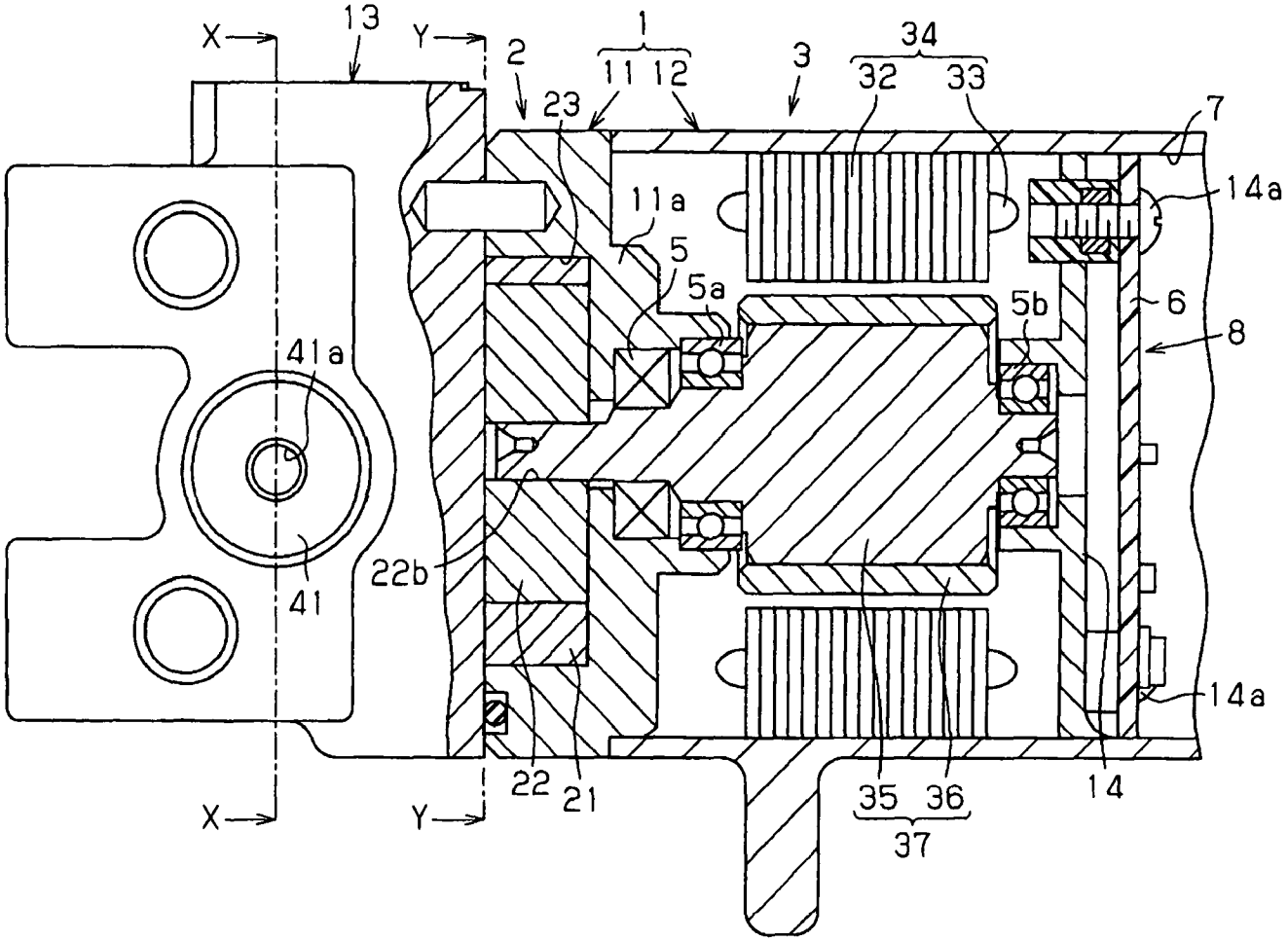
FIG. 1 is an axial sectional view depicting the construction of an electric pump unit according to an embodiment of the invention.

An electric pump unit of the embodiment is such as to be used as an electric oil pump for compensating for a reduction in oil pressure during an idle stop in an automotive transmission (gearbox) and includes, as is shown in FIG. 1, a housing main body 1, a pump part 2 which is accommodated in the housing main body 1 and which sucks and discharges an oil (a fluid) and an electric motor 3 for driving the pump part 2.

The housing main body 1 includes a pump housing 11 and a motor housing 12 which is made to communicate and is integrated with the pump housing 11. In addition, both the pump housing 11 and the motor housing 12 have a bottomed tubular shape, and both the housings 11, 12 are partitioned by a motor-side wall portion 11*a* of the pump housing 11 (a bottom portion of the pump housing 11).

The aforesaid pump part 2 is accommodated in the pump housing 11, and the pump part 2 has an outer rotor 21 having a trochoidal tooth profile and an inner rotor 22 which is made to mesh with the outer rotor 21 for rotation, configuring a so-called trochoid pump which sucks and discharges an oil by rotation of both the rotors 21, 22 within the pump housing 11. Here, in the pump housing 11, a cylindrical cavity portion which accommodates the outer rotor 21 and the inner rotor 22 is sealed by a pump plate 13 which has a thickness in an axial direction of the electric motor, so as to define a pump accommodating space 23.

The electric motor 3 is accommodated in the motor housing 12, and the electric motor 3 has a rotor core 35 which supports the inner rotor 22 at its through hole 22*b* and is configured in such a manner as to drive the pump part 2 via the rotor core 35. In addition, in the housing main body 1 shown in FIG. 1, a through hole into which a distal end portion of the rotor core 35 is to be inserted is formed in a substantially radial central portion of the motor-side wall portion 11*a*. In addition, an oil seal 5 is attached to an electric motor 3 side inner surface of the through hole, so that oil which passes through the pump accommodating space 23 does not seep into a space where to accommodate the electric motor 3 within the motor housing 12.

The electric motor 3 has, as main constituent members, a stator 34 in which coils 33 are wound around a stator core 32 having a plurality of teeth via insulators made from a resin (an insulating substance) and a motor rotor 37 in which a ring-shaped magnet 36 is fastened to an outer circumference of the rotor core 35. In addition, the magnet 36 is supported by a large diameter portion of the rotor core 35, and the motor core 35 is supported by the housing main body 1 via a first rolling bearing 5*a* which is provided in a central portion of the motor-side wall portion 11*a* and a second rolling bearing 5*b* which is provided in a central portion of a bottom plate 14 of the motor housing 12.

Figure 2A:
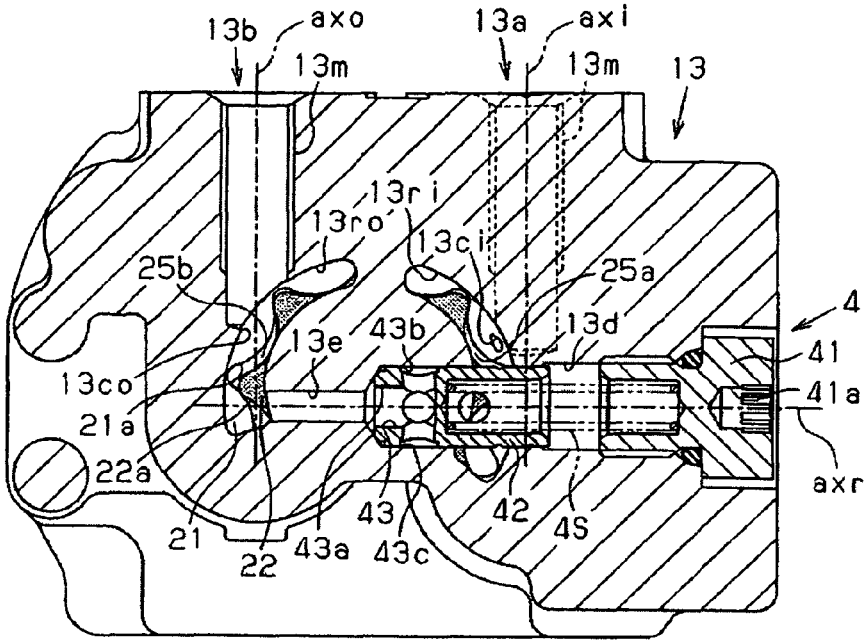
FIG. 2A is a sectional view of the electric pump unit shown in FIG. 1 taken along the line X-X and viewed in a direction indicated by arrows attached to the line.
Figure 2B:
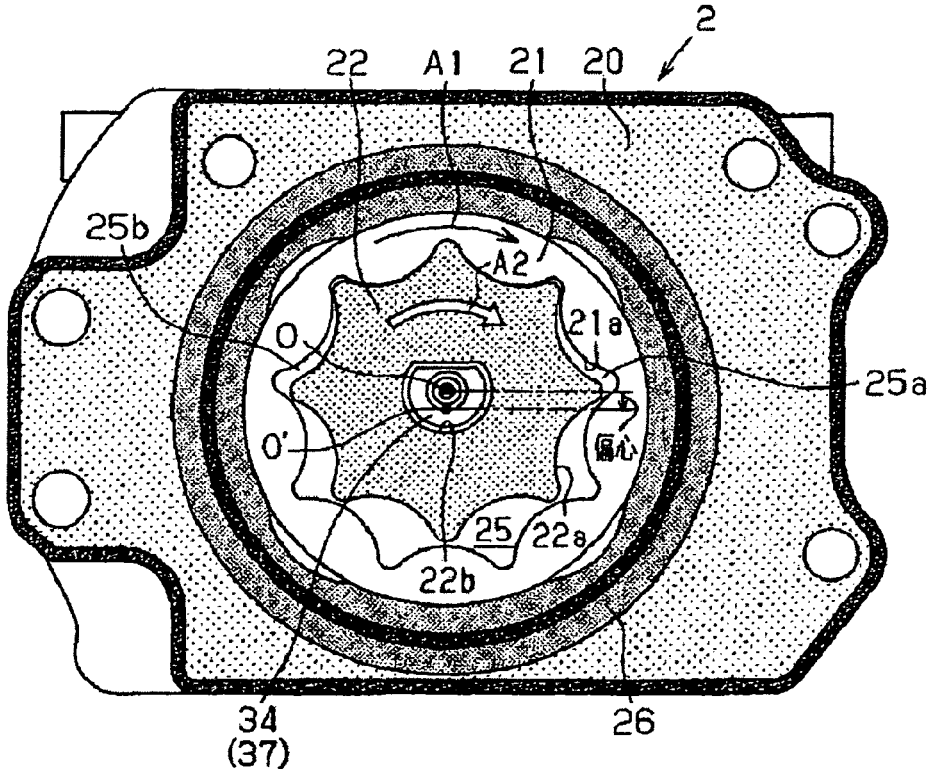
FIG. 2B is a sectional view of the same electric pump unit taken along the line Y-Y and viewed in a direction indicated by arrows attached to the line.

The outer rotor 21 and the inner rotor 22 are driven by the electric motor 3 to rotate in directions indicated by arrows A1, A2 as is shown in FIG. 2B, respectively. In addition, an arc-shaped pump chamber 25 is defined between tooth spaces 21*a*, 22*a* which form trochoidal tooth profiles of both the rotors 21, 22, and as both the rotors 21, 22 rotate, a low pressure portion 25*a* and a high pressure portion 25*b* are formed on an inlet side and an outlet side within the pump chamber 25, respectively. In addition, an inlet port 13*a* and an outlet port 13*b*, which are connected to exterior pipings, are formed in the pump plate 13 in such a manner as to communicate with the low pressure portion 25*a* and the high pressure portion 25*b*, respectively.

Figure 3:
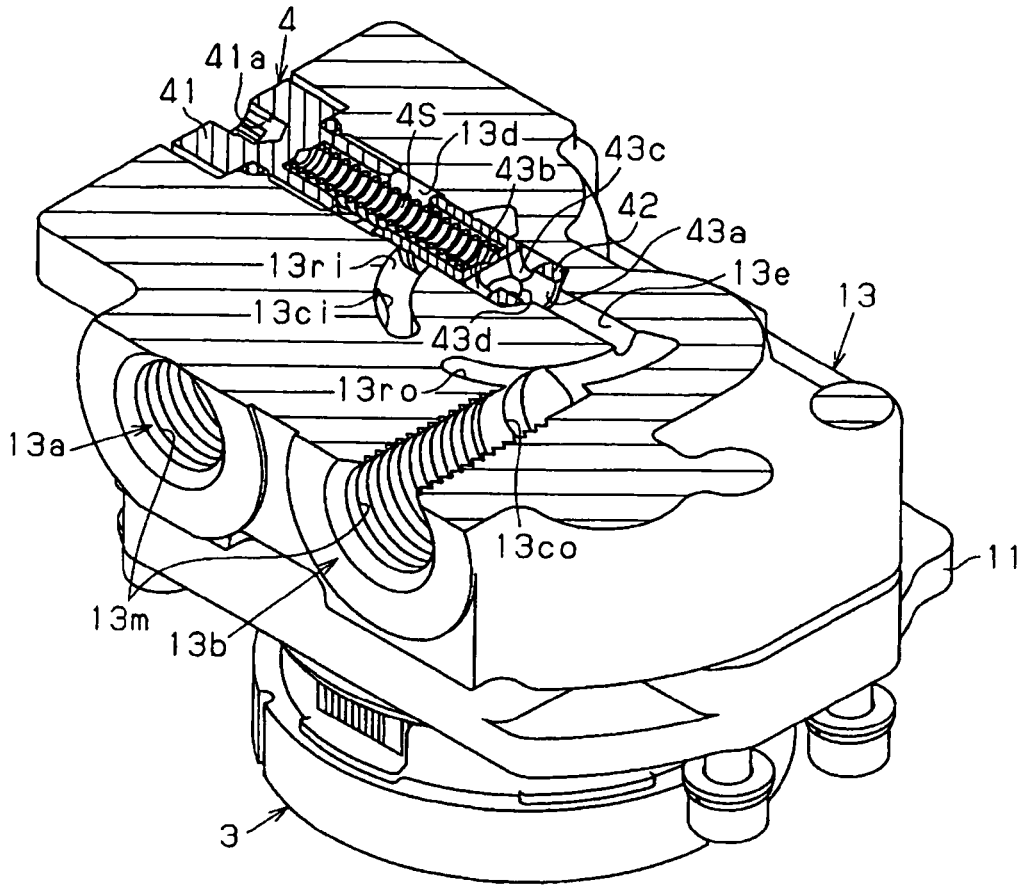
FIG. 3 is a perspective sectional view (including the section taken along the line X-X in FIG. 1) which depicts a main part of the electric pump unit shown in FIG. 1.

Specifically, as is shown in FIG. 3, crescent-shaped inlet side oil passage 13*ri* and outlet side oil passage 13*ro* are formed in the pump plate 13 in such a manner as to penetrate through the pump plate 13 in a thickness direction so as not only to communicate with the low pressure side 25*a* and the high pressure side 25*b*, respectively, but also to extend along outer circumferential circular arcs (upper circular arcs) of the rotors 21, 22, respectively. In addition, the inlet port 13*a* and the outlet port 13*b* are formed in such a manner as to extend in a straight line upwards (outwards) along predetermined axes axi, axo (a vertical direction as viewed in FIG. 2A) so as to communicate with the oil passages 13*ri*, 13*ro* at communication ports 13*co*, 13*ci*, respectively. In other words, the inlet port 13*a* and the outlet port 13*b* are formed in such a manner as to extend in the same direction along the predetermined axes axi, axo so as to communicate with the oil passages 13*ri*, 13*ro* at the communication ports 13*co*, 13*ci*, respectively.

In addition, a circulating oil passage 13*e* which is formed by a cylindrical cavity portion is formed in the pump plate 13 in such a manner as not only to communicate with a lower portion of the outlet side oil passage 13*ro* but also to extend in a rightward direction along an axis axr (a left-right direction in FIG. 2A). Further, a valve mounting hole 13*d*, which is made larger in diameter than the circulating oil passage 13*e*, is formed in the circulating oil passage 13*e* in such a manner as not only to communicate with the oil passage 13*e* along the axis axr but also to communicate with a lower portion of the inlet side oil passage ri.

In addition, in the pump plate 13 shown in FIG. 2A, thread portions 13*m*, 13*m* which screw on to corresponding exterior pipes are provided individually in the respective ports 13*a*, 13*b*. In addition, in the pump plate 13 shown in FIG. 2B, a direction (a downward direction in FIG. 2B) in which the outer rotor 21 becomes eccentric relative to the inner rotor 22 and a direction (an upward direction in FIG. 2B) in which the respective ports 13*a*, 13*b* extend outwards are made vertically opposite to each other.

This embodiment is characterized in that as is shown in FIGS. 2A and 3, a relief valve 4 is provided in the pump plate 13 in such a manner as to face the inlet port 13*a* and the outlet port 13*b* as an oil (fluid) circulating means for circulating oil from the high pressure portion 25*b* (the outlet port 13*b*) side to the low pressure 25*a* (the inlet port 13*a*) side when the oil pressure (fluid pressure) at the high pressure side 25*b* reaches or exceeds a predetermined pressure (0.5 MPa in this embodiment).

Specifically, the relief valve 4 includes a bottomed cylindrical adjusting screw 41, a spool 42 and a spring 4*s* which is interposed between the adjusting screw 41 and the spool 42 (the spring 4*s* is fitted in a cavity portion between the adjusting screw 41 and the spool 42 and is fixed to the respective members 41, 42 at both end portions thereof) and is mounted (fitted) operatively in the valve mounting hole 13*d*. Namely, the relief valve 4 is made to communicate operatively with the respective crescent-shaped oil passages 13*ri*, 13*ro* in such a state that its axis axr in the operating direction (refer to FIG. 2A) is made to intersect the axes axi, axo of the respective ports 13*a*, 13*b* substantially at right angles within a plane which intersects a motor rotor 37 (a rotating shaft) of the electric motor 3 and in such a manner as not to communicate with the respective ports 13*a*, 13*b*. In addition, a T-shaped oil passage 43 is formed in the spool 42 of the relief valve shown in FIGS. 2A and 3 in such a manner as to penetrate therethrough so that oil which flows in from an opening 43*a* at a distal end portion thereof is discharged to the outside from two openings 43*b*, 43*c* in left-hand and right-hand surface portions. In addition, an operating portion 41*a* having a groove in which a distal end of a driver is fitted is provided in a recessed fashion at a rear end portion of the adjusting screw 41.

Additionally, in this embodiment, as is shown in FIG. 2B, a direction in which (a rotational center O' of) the outer rotor 21 becomes eccentric relative to (a rotational center O of) the inner rotor 22 and a direction in which the inlet port 13*a* and the outlet port 13*b* extend outwards are made opposite to each other. Because of this, the crescent-shaped oil passages 13*ri*, 13*ro* can be formed in the pump plate 13 in such a state that they lie close to each other at an opposite side in direction to the direction in which the respective rotors 21, 22 become eccentric relative to each other, and in the inlet port 13*a* and the outlet port 13*b*, the overall length of the thread portion 13*m* which screws on to the exterior piping can be ensured sufficiently. Therefore, the connection between the respective ports 13*a*, 13*b* and the exterior pipings can be made ensured and strong and rigid.

Returning to FIG. 1, in this embodiment, further, a circuit board 6 for controlling the electric motor 3 is attached to the motor housing 12 via screws 14*a*, 14*a* from a bottom plate 14 side of the motor housing 12. In addition, the circuit board 6 is accommodated in a controller accommodating portion 7 together with electronic components on the circuit board 6 such as coils and condensers and a controller 8 for the electric pump unit is made up of those members.

The electric pump unit of the embodiment is configured as has been described heretofore and provides the following function. Namely, as the motor rotor 37 of the electric motor 3 shown in FIG. 1 rotates, the outer rotor 21 and the inner rotor 22 rotate about their rotational centers O', O. By this action, in the meshing portion of both the rotors 21, 22, its volume is increased at the low pressure portion 25*a* to thereby generate a negative pressure, whereby oil is sucked in from the outside through the inlet port 13*a*, the communication port 13*ci* and the oil passage 13*ri*. The oil so sucked in is sealed within the pump chamber 25 defined between the tooth spaces 21*a*, 22*a* of both the rotors 21, 22 and is delivered towards the outlet side by the rotation of both the rotors 21, 22. In addition, in the meshing portion between both the rotors 21, 22, the volume of the high pressure portion 25*b* is decreased as both the rotors 21, 22 rotate to thereby increase the pressure therein, whereby the oil is discharged outwards through the oil passage 13*ro*, the communication port 13*co* and the discharge port 13*b*.

Figure 4A:
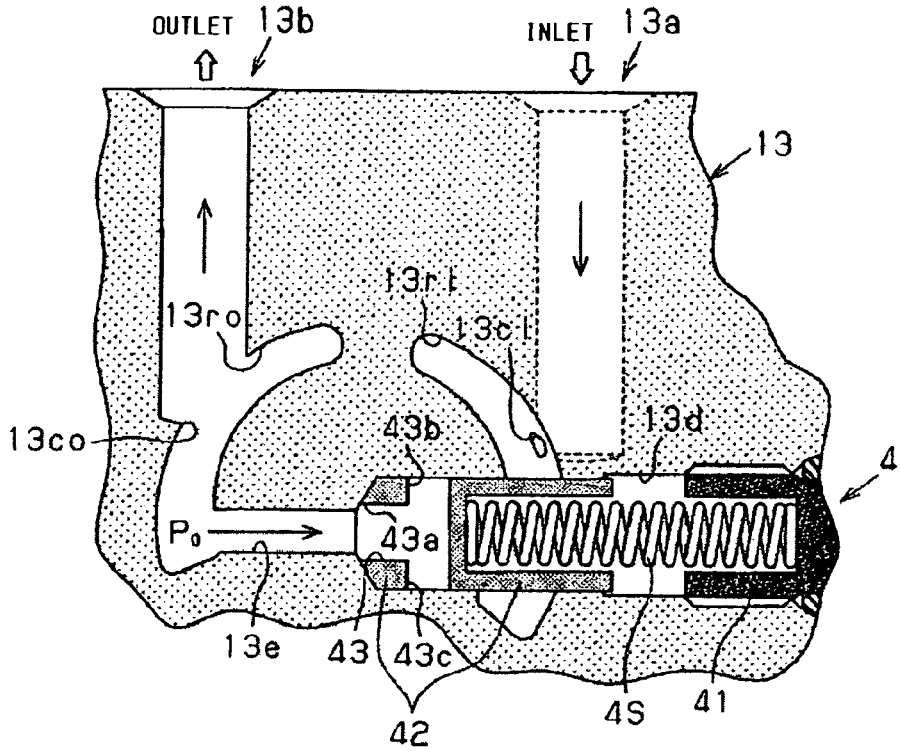
FIG. 4A is a functional view depicting an operating state of a relief valve which is in a steady state in the same electric pump unit.

Here, when the oil pressure at the high pressure portion 25*b* (the outlet port 13*b*) side of the pump chamber 25 is less than 0.5 MPa ($P_0$<0.5 MPa), as is shown in FIG. 4A, the spool 42 of the relief valve 4 lies in a position where the spool 42 is pushed into an end portion of the valve mounting hole 13*d* by the biasing force of the spring 4*s*. In this state, the T-shaped oil passage 43 of the spool 42 does not communicate with the inlet side oil passage 13*ri*, resulting in a state in which a communication between the oil passage 13*ri* and the outlet side oil passage 13*ro* is shut off by a side wall portion of the spool 42. In addition, in this state, the electric motor 3 continues to operate normally.

Figure 4B:
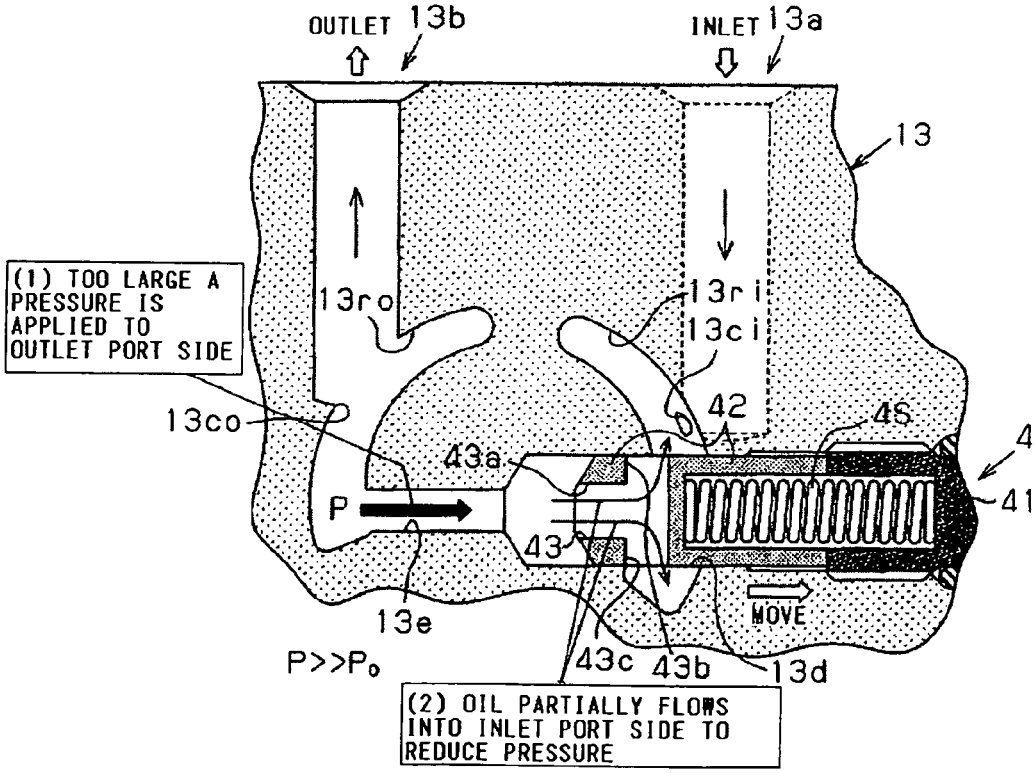
FIG. 4B is a functional view depicting an operating state of the relief valve which results when too large a pressure is applied to an outlet side in the same electric pump unit.

On the other hand, when the oil pressure at the high pressure portion 25*b* side of the pump chamber 25 reaches or exceeds 0.5 MPa (P≧0.5 MPa), as is shown in FIG. 4B, the spool 42 of the relief valve 4 is pushed back to the adjusting screw 41 side along the axis axr against the biasing force of the spring 4*s* by the oil pressure P so as to be shifted (displaced) quickly and in an ensured fashion, whereby the T-shaped oil passage 43 in the spool 42 comes to communicate with the inlet side oil passage 13*ri* via the openings 43*b*, 43*c* in the left-hand and right-hand wall portions. Then, part of the oil in the outlet side oil passage 13*ro* flows into the oil passage 13*ri*, whereby the oil pressure P at the high pressure portion 25*b* is decreased. In addition, in the event that the state is left as it is in which too large a pressure P (P≧0.5 MPa) is being applied to the outlet port 13*b* (the outlet side oil passage 13*ro*) side by the oil, the electric motor 3 is put in an overloaded state, thereby generating a so-called motor step-out phenomenon in which an angle deviation is generated between the motor rotor 37 and the stator 34 (the rotating portion) and the rotation of the motor comes to a halt, resulting in the electric motor 3 eventually becoming unable to be restored from it.

Thus, according to the electric pump unit of the embodiment, the following functions and advantages can be obtained.

(1) In this embodiment, the electric pump unit has the so-called trochoid pump construction, and the pump part 2 which sucks and discharges oil is provided with the relief valve 4 for circulating oil from the outlet side to the inlet side when the oil pressure at the outlet side reaches or exceeds the predetermined pressure (0.5 MPa). Because of this, since the pressure at the outlet side is decreased by the oil being circulated from the outlet side to the inlet side before the oil pressure at the outlet side of the pump part 2 becomes too large to thereby put the electric motor 3 in the overloaded state, the so-called motor step-out phenomenon can effectively be prevented in which the angle deviation is generated between the motor rotor 37 of the electric motor 3 and the stator 34 (the rotating portion) and the rotation of the electric motor comes to a halt, resulting in the electric motor 3 becoming unable to be restored from it, thereby making it possible to enhance the reliability of the electric pump unit as being used in motor vehicles.

(2) In this embodiment, by the fluid circulating means for circulating oil (fluid) from the outlet side to the inlet side when the oil pressure at the outlet side reaches or exceeds the predetermined pressure (0.5 MPa) being made into the relief valve, the fluid circulating means can be made simple in construction and easy to be mounted in the electric pump unit as the mechanical component. Moreover, the fluid circulating means can be made to respond quickly and operate in an ensured fashion.

(3) In this embodiment, in the pump plate 13 which closes the cylindrical cavity portion within the bottomed cylindrical pump housing 11, the relief valve 4 and the inlet port 13*a* and the outlet port 13*b* are provided without interfering with each other, and the space where to form the inlet port 13*a* and the outlet port 13*b* can be ensured sufficiently without interrupting the operation of the relief valve 4 in any way. In addition, since the respective ports 13*a*, 13*b* are formed in the direction which intersects the axial direction of the electric motor 3 at right angles in the pump plate 13, the thickness of the pump plate 13 can be made thin, and this comes to contribute to the miniaturization in size (the reduction in overall length) of the electric pump unit.

(4) In this embodiment, since the space where to form the inlet port 13*a* and the outlet port 13*b* can be ensured sufficiently in the pump plate 13, in the respective ports 13*a*, 13*b*, the overall length of the thread portion 13*m* which screws on to the exterior piping can be formed long and threads of the thread portion 13*m* can be formed tall for improved strength. Because of this, the connection between the respective ports 13*a*, 13*b* with the exterior pipings can be made ensured and strong and rigid while miniaturizing the electric pump unit.

(5) In this embodiment, the direction (an O-O' direction in FIG. 2B) in which (the rotational center O' of) the outer rotor 21 becomes eccentric relative to (the rotational center O of) the inner rotor 22 and the direction in which the inlet port 13*a* and the outlet port 13*b* extend outwards are made opposite to each other. Because of this, the crescent-shaped oil passages 13*ri*, 13*ro* which communicate respectively with the low pressure portion 25*a* and the high pressure portion 25*b* of the pump chamber 25 and extend respectively along the outer circumferential arcs of the rotors 21, 22 can be formed in the pump plate 13 in such a state that they lie close to each other at the opposite side in direction to the direction in which the respective rotors 21, 22 are placed eccentric to each other. As a result, in the pump plate 13, the relief valve 4 can be provided in the space which is ensured widely without being occupied by the respective crescent-shaped oil passages 13*ri*, 13*ro* at the side where both the rotors 21, 22 are made eccentric to each other.

In addition, the embodiment may be modified as below.

In the aforesaid embodiment, the relief valve is used as the fluid circulating means for circulating oil from the high pressure portion 25*b* (outlet) side to the low pressure portion 25*b* (inlet) side when the oil pressure at the high pressure portion 25 side reaches or exceeds the predetermined pressure. However, the invention is not limited thereto, and a different actuator can also be used as the clued circulating means which circulates oil to the low pressure portion 25*a* side by detecting an oil pressure at the high pressure portion 25*b* side.

In the aforesaid embodiment, while the electric pump unit is used as the electric oil pump for compensating for a reduction in oil pressure which occurs during an idle stop in the automotive transmission, the electric pump unit of the invention can also be used for other automotive applications, for example, as a steering pump for assisting in automotive steering operations and the electric pump unit can also be used widely for applications other than these automotive applications.

In the aforesaid embodiment, the inlet port 13*a* and the outlet port 13*b* which are connected to the exterior pipings are formed in the pump plate 13 which closes the cavity portion in the pump housing 11. However, the invention is not limited thereto, and hence, the respective ports 13*a*, 13*b* can be formed directly in the pump housing 11 and can also be configured by other members than the pump housing 11 and the pump plate 13.

In the aforesaid embodiment, the pump part has been described as being the internal gear pump employing the trochoidal tooth profile which is made up of the outer rotor having the trochoidal tooth profile and the inner rotor which meshes with the outer rotor in such a state that the outer rotor and the inner rotor are placed eccentric relative to each other. However, the invention is not limited thereto and hence, the pump part may be a different internal gear pump which is made up of an outer rotor which is an external gear and an inner rotor which is an internal gear.

The invention claimed is:

1. An electric pump unit comprising:

an outer rotor;

an inner rotor which meshes with the outer rotor in such a state that the inner rotor and the outer rotor are placed eccentrically to each other and which is driven by being supported by a rotation shaft of an electric motor;

a pump housing which defines a cavity portion which accommodates therein the outer rotor and the inner rotor;

inlet and outlet ports which are provided on inlet and outlet sides, respectively, so as to suck and discharge a fluid and which communicate with each other via the cavity portion; and a fluid circulating unit for circulating the fluid from the outlet side to the inlet side when a fluid pressure at the outlet side reaches or exceeds a predetermined pressure, wherein the fluid circulating unit comprises a relief valve which is provided so as to face the inlet and outlet ports, wherein a pump plate is provided so as to seal the cavity portion, wherein crescent-shaped oil passages are formed at the inlet and outlet sides, respectively, so as to extend along outer circumferential circular arcs of the inner rotor and the outer rotor, wherein the inlet and outlet ports are formed in the pump plate in such a manner as to extend in the same direction along predetermined axes so as to communicate with the oil passages, respectively, and wherein the relief valve is provided in the pump plate in such a state that an axis in an operating direction of the relief valve is made to intersect the axes of the inlet and outlet ports substantially at right angles in a plane which intersects the rotating shaft of the electric motor at right angles and in such a manner as to operatively communicate with the respective oil passages without communicating with the inlet and outlet ports.

2. The electric pump unit according to claim 1, wherein thread portions are provided individually in the inlet and outlet ports in such a manner as to screw individually on to exterior pipes.

3. The electric pump unit according to claim 2, wherein a direction in which the outer rotor becomes eccentric relative to the inner rotor and a direction in which the respective ports extend outwards are made opposite to each other.

4. An electric oil pump for compensating for a reduction in oil pressure which occurs during an idle stop in a transmission for a vehicle such as an automobile, employing an electric pump unit according to claim 2.

5. The electric pump unit according to claim 1, wherein a direction in which the outer rotor becomes eccentric relative to the inner rotor and a direction in which the respective ports extend outwards are made opposite to each other.

6. An electric oil pump for compensating for a reduction in oil pressure which occurs during an idle stop in a transmission for a vehicle such as an automobile, employing an electric pump unit according to claim 5.

7. An electric oil pump for compensating for a reduction in oil pressure which occurs during an idle stop in a transmission for a vehicle such as an automobile, employing an electric pump unit according to claim 1.

* * * * *